US009434165B2

(12) United States Patent
Edelen et al.

(10) Patent No.: US 9,434,165 B2
(45) Date of Patent: Sep. 6, 2016

(54) CHIP LAYOUT TO ENABLE MULTIPLE HEATER CHIP VERTICAL RESOLUTIONS

(71) Applicant: FUNAI ELECTRIC CO., LTD., Osaka (JP)

(72) Inventors: John Glenn Edelen, Lexington, KY (US); Nicole Semler, Lexington, KY (US); Michael Marra, Lexington, KY (US)

(73) Assignee: FUNAI ELECTRIC CO., LTD. (JP)

( * ) Notice: Subject to any disclaimer, the term of this patent is extended or adjusted under 35 U.S.C. 154(b) by 0 days.

(21) Appl. No.: 14/472,297

(22) Filed: Aug. 28, 2014

(65) Prior Publication Data

US 2016/0059560 A1 Mar. 3, 2016

(51) Int. Cl.
*B41J 2/14* (2006.01)
*B41J 2/16* (2006.01)

(52) U.S. Cl.
CPC ..... *B41J 2/14427* (2013.01); *B41J 2/14072* (2013.01); *B41J 2/1603* (2013.01); *B41J 2/1628* (2013.01); *B41J 2/1629* (2013.01); *B41J 2/1631* (2013.01); *B41J 2/1632* (2013.01); *B41J 2/1648* (2013.01); *B41J 2/14129* (2013.01); *B41J 2202/13* (2013.01)

(58) Field of Classification Search
None
See application file for complete search history.

(56) References Cited

U.S. PATENT DOCUMENTS

| | | | | |
|---|---|---|---|---|
| 5,648,805 | A | 7/1997 | Keefe et al. | |
| 5,719,605 | A | 2/1998 | Anderson et al. | |
| 6,860,587 | B2 | 3/2005 | Torgerson et al. | |
| 7,722,144 | B2 * | 5/2010 | Benjamin et al. | 347/12 |
| 7,832,843 | B2 * | 11/2010 | Oikawa | B41J 2/145 347/20 |
| 2004/0183843 | A1 | 9/2004 | Walmsley et al. | |
| 2004/0233255 | A1 * | 11/2004 | Parish et al. | 347/63 |
| 2009/0027429 | A1 | 1/2009 | Jung | |
| 2009/0109261 | A1 | 4/2009 | Omata et al. | |
| 2010/0208003 | A1 | 8/2010 | Silverbrook | |
| 2013/0010033 | A1 | 1/2013 | Endo et al. | |

* cited by examiner

*Primary Examiner* — Lisa M Solomon
(74) *Attorney, Agent, or Firm* — Amster, Rothstein Ebenstein LLP

(57) ABSTRACT

An inkjet printer including a printhead with a fluid ejection chip and an associated method of forming is described. The fluid ejection chip includes a substrate, a plurality of groups of drive elements formed on the substrate, and a plurality of fluid ejection devices disposed on the substrate. Each group of drive elements includes at least two drive elements electrically coupled in parallel. Each fluid ejection device of the plurality of fluid ejection devices is electrically coupled with a respective group of the plurality of groups of drive elements so that the plurality of drive elements selectively activate the plurality of fluid ejection devices for causing fluid to be expelled from the printhead in accordance with image data.

20 Claims, 15 Drawing Sheets

CHIP LAYOUT TO ENABLE MULTIPLE HEATER CHIP VERTICAL RESOLUTIONS

RELATED APPLICATION

This application is related to U.S. patent application Ser. No. 14/472,307, filed Aug. 28, 2014, entitled ADDRESS ARCHITECTURE FOR FLUID EJECTION CHIP, the contents of which are incorporated herein by reference in their entirety.

FIELD

The present invention relates to thermal inkjet printers and methods of forming the same, and more particularly, relates to different resolution thermal inkjet printheads and methods of forming the same using a common thermal ejection chip design.

BACKGROUND

Inkjet printers eject liquid ink droplets onto a recording medium, such as paper, from a printhead that moves relative to the recording medium and/or vice-versa. A printhead generally comprises one or more thermal ejection chips, each including a semiconductor substrate upon which one or more heater elements, such as electrical resistors, are disposed for transferring thermal energy into liquid ink. The liquid ink is heated such that a rapid volumetric change occurs in the ink resulting from a liquid to vapor transition and, consequently, the ink is forcibly ejected from the printhead as an ink droplet onto a recording medium.

In typical ejection chip designs, one of the first variables to be fixed is the vertical resolution of drop placement, i.e., the vertical spacing between drops of ink ejected from an ejection chip. From this starting point other properties such as the heater addressing matrix, input data register length, and chip clock speeds, to name a few, can be defined. Using this method, ejection chips with similar properties except for vertical resolution often have dissimilar electrical interfaces which require specific components for operation, for example, a unique ASIC, driver card and/or carrier for each design, to name a few. While this may provide a cost effective bill of materials for a specific design, such savings can be offset by increased development resources and time to market. Therefore, this design approach is best suited for high volume designs with long product life cycles.

SUMMARY

An object of the present invention is to provide an improved chip architecture that enables shorter development cycles and customized designs to fit individual customer needs.

It is further an object of the present invention to provide a common chip base upon which a plurality of thermal ejection chip configurations can be achieved.

According to an exemplary embodiment, a method of fabricating a fluid ejection chip, and the resulting fluid ejection chip are disclosed. The method comprises: (a) providing a substrate; (b) forming a plurality of drive elements on the substrate; (c) forming a plurality of groups of drive elements, each group comprising at least two drive elements of the plurality of drive elements electrically coupled in parallel; (d) forming a plurality of fluid ejection devices on the substrate; and (e) electrically coupling each fluid ejection device of the plurality of fluid ejection devices with a respective group of the plurality of groups of drive elements so that the plurality of drive elements selectively activate the plurality of fluid ejection devices for causing fluid to be expelled from the printhead in accordance with image data.

In exemplary embodiments, the method comprises the step of forming a via on the substrate that provides fluid communication between the fluid ejection elements and a fluid supply.

In exemplary embodiments, the plurality of drive elements comprises transistors.

In exemplary embodiments, the step of electrically coupling each fluid ejection device with a respective group of drive elements comprises depositing an electrical interconnect on the substrate.

In exemplary embodiments, each group comprises four drive elements.

According to an exemplary embodiment, a fluid ejection chip is disclosed that comprises a substrate, a plurality of groups of drive elements formed on the substrate, and a plurality of fluid ejection devices disposed on the substrate. Each group of drive elements includes at least two drive elements electrically coupled in parallel. Each fluid ejection device of the plurality of fluid ejection devices is electrically coupled with a respective group of the plurality of groups of drive elements so that the plurality of drive elements selectively activate the plurality of fluid ejection devices for causing fluid to be expelled from the printhead in accordance with image data.

In exemplary embodiments, the substrate further comprises a via that provides fluid communication between the fluid ejection devices and a fluid supply.

In exemplary embodiments, each fluid ejection device of the plurality of fluid ejection devices elements is vertically spaced from an adjacent fluid ejection device along the via.

In exemplary embodiments, the plurality of fluid ejection devices is formed in two columns, each column on an opposing side of the via.

In exemplary embodiments, each fluid ejection device of the plurality of fluid ejection devices elements is vertically spaced a uniform distance from a vertically-adjacent fluid ejection device along the via.

In exemplary embodiments, each column is vertically offset from the other column.

In exemplary embodiments, each column is vertically offset from the other column by a distance that is half a uniform vertical distance between each vertically-adjacent fluid ejection device of the plurality of fluid ejection devices.

In exemplary embodiments, the plurality of groups of drive elements is comprised of transistors.

In exemplary embodiments, each group comprises four drive elements electrically coupled in parallel.

According to an exemplary embodiment, an inkjet printer is disclosed that comprises a printhead comprising a fluid ejection chip. The fluid ejection chip comprises a substrate, a plurality of groups of drive elements formed on the substrate, and a plurality of fluid ejection devices disposed on the substrate. Each group of drive elements includes at least two drive elements electrically coupled in parallel. Each fluid ejection device of the plurality of fluid ejection devices is electrically coupled with a respective group of the plurality of groups of drive elements so that the plurality of drive elements selectively activate the plurality of fluid ejection devices for causing fluid to be expelled from the printhead in accordance with image data.

BRIEF DESCRIPTION OF THE DRAWINGS

The features and advantages of the present invention will be more fully understood with reference to the following, detailed description of illustrative embodiments of the present invention when taken in conjunction with the accompanying figures, wherein.

DETAILED DESCRIPTION

Figure 1:
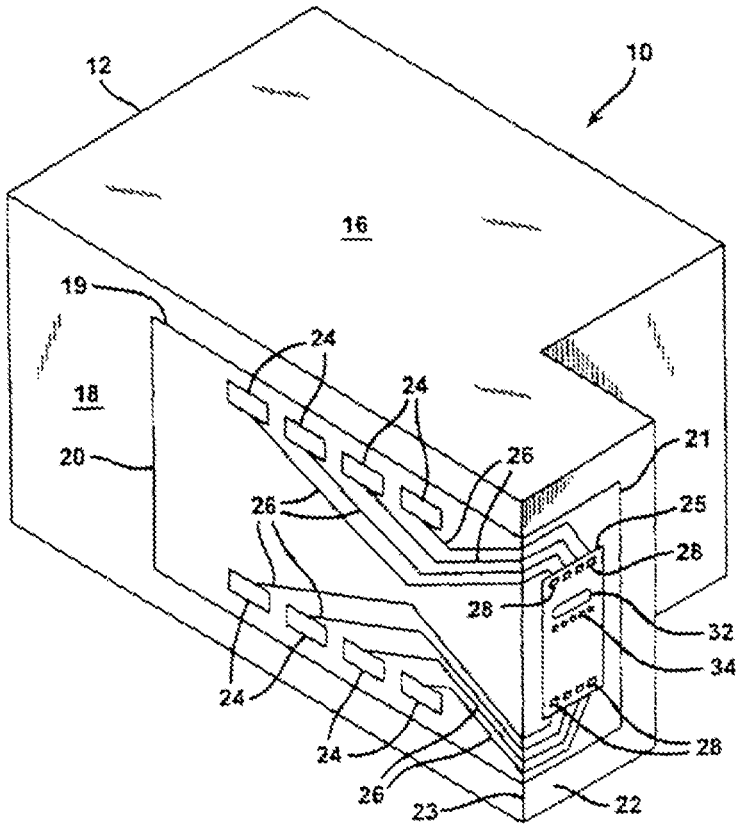
FIG. 1 is a perspective view of a conventional thermal inkjet printhead.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

With reference to FIG. 1, a conventional inkjet printhead of the present invention is shown generally as 10. The printhead 10 has a housing 12 formed of any suitable material for holding ink. Its shape can vary and often depends upon the external device that carries or contains the printhead. The housing has at least one internal compartment 16 for holding an initial or refillable supply of ink. In one embodiment, the compartment has a single chamber and holds a supply of black ink, photo ink, cyan ink, magenta ink or yellow ink. In other embodiments, the compartment has multiple chambers and contains multiple supplies of ink. Preferably, the compartment includes cyan, magenta and yellow ink. In still other embodiments, the compartment contains plurals of black, photo, cyan, magenta or yellow ink. It will be appreciated, however, that while the compartment 16 is shown as locally integrated within a housing 12 of the printhead, it may alternatively connect to a remote source of ink and receive supply, for example, from a tube.

Adhered to one surface 18 of the housing 12 is a portion 19 of a flexible circuit, especially a tape automated bond (TAB) circuit 20. The other portion 21 of the TAB circuit 20 is adhered to another surface 22 of the housing. In this embodiment, the two surfaces 18, 22 are perpendicularly arranged to one another about an edge 23 of the housing.

The TAB circuit 20 supports a plurality of input/output (I/O) connectors 24 for electrically connecting a heater chip 25 to an external device, such as a printer, fax machine, copier, photo-printer, plotter, all-in-one, etc., during use. Pluralities of electrical conductors 26 exist on the TAB circuit 20 to electrically connect and short the I/O connectors 24 to the input terminals (bond pads 28) of the heater chip 25. Those skilled in the art know various techniques for facilitating such connections. While FIG. 1 shows eight I/O connectors 24, eight electrical conductors 26 and eight bond pads 28, it will be understood that any number and/or configuration of connections may be provided.

The heater chip 25 contains a column 34 of a plurality of fluid firing elements that serve to eject ink from compartment 16 during use. The fluid firing elements may embody resistive heater elements formed as thin film layers on a silicon substrate. In embodiments, other types of configurations, such as those with piezoelectric elements, may be used. The pluralities of fluid firing elements in column 34 are shown adjacent an ink via 32 as a row of five dots but in practice may include several hundred or thousand fluid firing elements. As described below, vertically adjacent ones of the fluid firing elements may or may not have a lateral spacing gap or stagger there between. In general, the fluid firing elements have vertical pitch spacing comparable to the dots-per-inch resolution of an attendant printer. Some examples include spacing of $1/300^{th}$, $1/600^{th}$, $1/1200^{th}$, $1/2400^{th}$ or other of an inch along the longitudinal extent of the via. To form the vias, many processes are known that cut or etch the via 32 through a thickness of the heater chip. Some of the more preferred processes include grit blasting or etching, such as wet, dry, reactive-ion-etching, deep reactive-ion-etching, or other. A nozzle plate (not shown) has orifices thereof aligned with each of the heaters to project the ink during use. The nozzle plate may attach with an adhesive or epoxy or may be fabricated as a thin-film layer.

Figure 2:
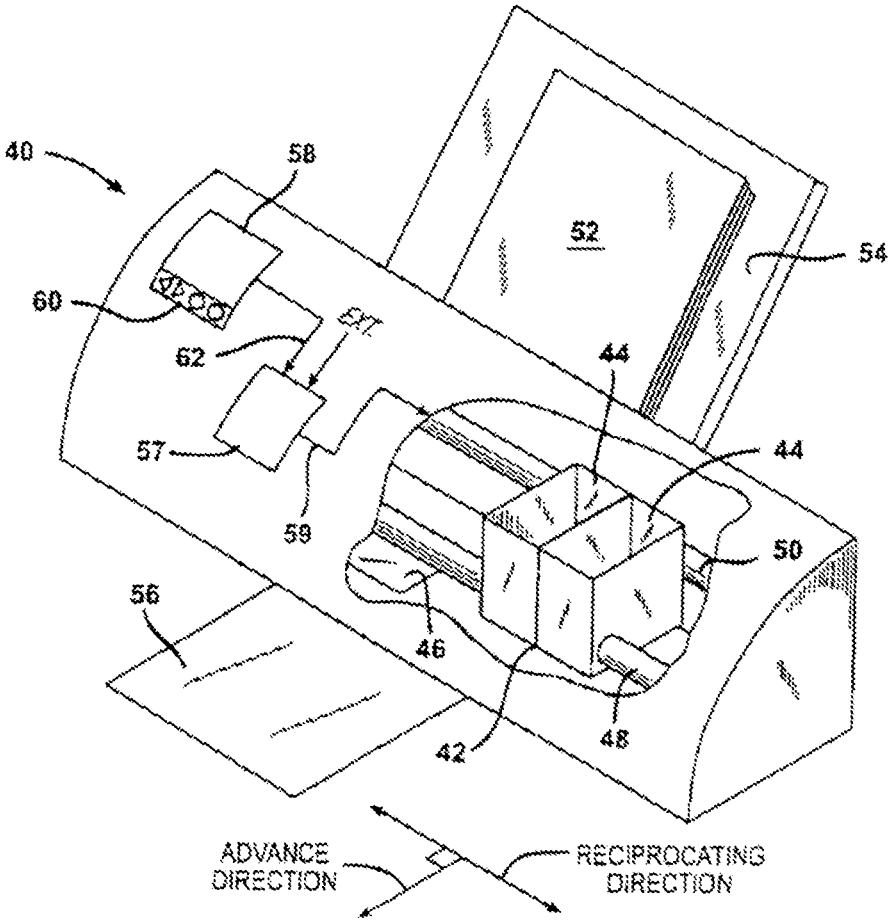
FIG. 2 is a perspective view of a conventional inkjet printer.

With reference to FIG. 2, an external device in the form of an inkjet printer for containing the printhead 10 is shown generally as 40. The printer 40 includes a carriage 42 having a plurality of slots 44 for containing one or more printheads 10. The carriage 42 reciprocates (in accordance with an output 59 of a controller 57) along a shaft 48 above a print zone 46 by a motive force supplied to a drive belt 50. The reciprocation of the carriage 42 occurs relative to a print medium, such as a sheet of paper 52 that advances in the printer 40 along a paper path from an input tray 54, through the print zone 46, to an output tray 56.

While in the print zone, the carriage 42 reciprocates in the Reciprocating Direction generally perpendicularly to the paper 52 being advanced in the Advance Direction as shown by the arrows. Ink drops from compartment 16 (FIG. 1) are caused to be ejected from the heater chip 25 at such times pursuant to commands of a printer microprocessor or other controller 57. The timing of the ink drop emissions corresponds to a pattern of pixels of the image being printed. Often times, such patterns become generated in devices electrically connected to the controller 57 (via Ext. input) that reside externally to the printer for example, a computer, a scanner, a camera, a visual display unit, and/or a personal data assistant, to name a few.

To print or emit a single drop of ink, the fluid firing elements (the dots of column 34, FIG. 1) are uniquely addressed with a small amount of current to rapidly heat a small volume of ink. This causes the ink to vaporize in a local ink chamber between the heater and the nozzle plate and eject through, and become projected by, the nozzle plate towards the print medium. The fire pulse required to emit such ink drop may embody a single or a split firing pulse and is received at the heater chip on an input terminal (e.g., bond pad 28) from connections between the bond pad 28, the electrical conductors 26, the I/O connectors 24 and controller 57. Internal heater chip wiring conveys the fire pulse from the input terminal to one or many of the fluid firing elements.

A control panel 58, having user selection interface 60, also accompanies many printers as an input 62 to the controller 57 to provide additional printer capabilities and robustness.

It will be understood that the inkjet printhead 10 and inkjet printer 40 described above are exemplary, and that other inkjet printheads and/or inkjet printer configurations may be used with the various embodiments of the present invention.

Figure 3A:
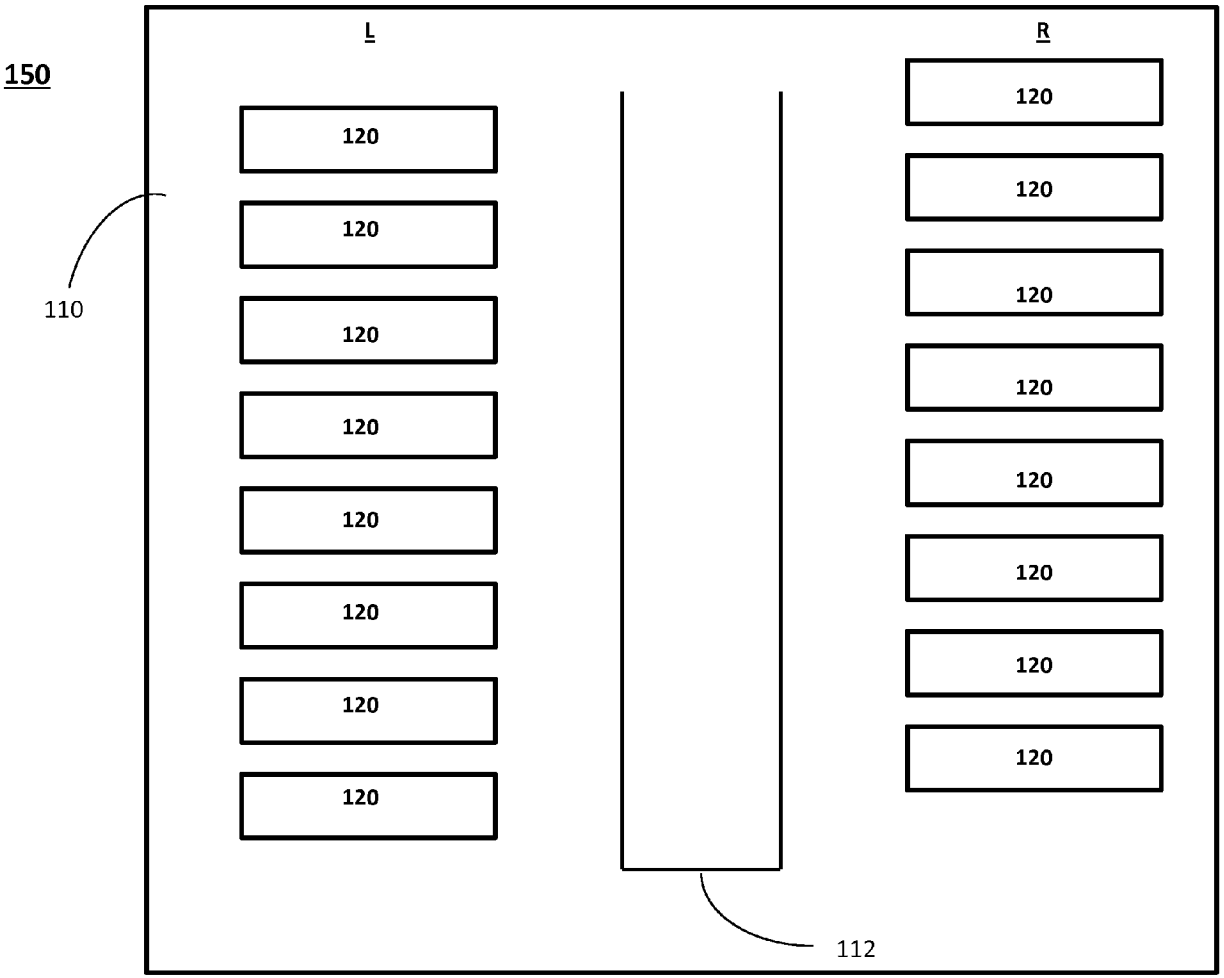
FIG. 3A is a first sequential block diagram of a thermal ejection chip during fabrication according to an exemplary embodiment of the present invention.

Turning now to FIG. 3A, a block diagram of a thermal ejection chip 100 (FIG. 3B) according to an exemplary embodiment of the present invention is shown during fabrication. Thermal ejection chip 100 includes a substrate 110 upon which other components of the thermal ejection chip 100 are supported. Substrate 110 is formed of one or more materials that is at least partially electrically conductive, and preferably having electrical conduction properties that can be manipulated according one or more performance needs of thermal ejection chip 100. In the exemplary embodiment shown, substrate 110 is formed of a semiconductor material, for example, silicon. In embodiments, substrate 110 may be formed of additional and/or alternative materials, for example, carbon, zinc, germanium and/or gallium, to name a few.

As shown, substrate 110 is provided in a substantially rectangular block shape, and may have been formed from, for example, a silicon wafer, to have such a configuration or may have been subject to one or more shaping processes, for example, dicing or cutting. In embodiments, substrate 110 may be provided in a substantially unprocessed configuration, for example, having one or more surface deformities and/or having an asymmetrical configuration.

Substrate 110 may be subject to one or more processes that form fluid channels within and/or along the substrate 110 and that define and/or deposit active electrical circuit elements or drive elements along portions of substrate 110. Such processes, termed front-end-of-line (FEOL) processes, may include, for example, semiconductor doping, etching, grit blasting, chemical-mechanical planarization, deposition of one or more layers of materials, and/or photolithographic patterning, to name a few.

In the exemplary embodiment described herein, FEOL processing is used to form a centrally-disposed ink via 112 along a portion of substrate 110. Ink via 112 may be in fluid communication with a reservoir of liquid ink, such as compartment 16 of a printhead 10 (FIG. 1), such that ink via 112 may provide a local source of liquid ink to thermal ejection chip 100. In embodiments, ink via 112 may have a different placement and/or configuration from that shown.

The FEOL processing of substrate 110 also disposes a number of drive elements, such as, for example, field effect transistors (FETs) 120 along thermal ejection chip 100. Each FET 120 may include a gate as well as source and drain terminals, so that a potential difference applied between the gate and the source terminal affects a conductive channel along which electrons flow between the source and the drain terminal. It will be understood that alternative configurations of transistors may be used in addition to and/or in place of FETs 120. In embodiments, FEOL processing may produce additional and/or alternative active circuit elements or drive elements on a substrate, for example, diodes, silicon-controlled rectifier devices (SCRs), and/or logic cells, to name a few. As described further herein, the configuration of substrate 110 and FETs 120 at the end of FEOL processing provides a base chip 150 upon which a plurality of configurations of thermal ejection chips may be selectively formed through subsequent processing steps.

Such a set of subsequent processing steps following FEOL processing, termed back-end-of-line (BEOL) processes include providing one or more interconnecting electrical elements, e.g., metallic wiring and/or contacts, between electrical elements and/or circuits defined on the semiconductor substrate 110 and/or portions thereof. Accordingly, BEOL processing steps may include deposition of materials on the substrate 110 such as conductive materials, resistive materials, and/or insulative materials, to name a few. In this regard, one or more completed electrical circuits are formed at the conclusion of BEOL processing. The FEOL and BEOL processes described above may be varied, for example with a different number of and/or alternative processing steps, to achieve desired results.

Figure 3B:
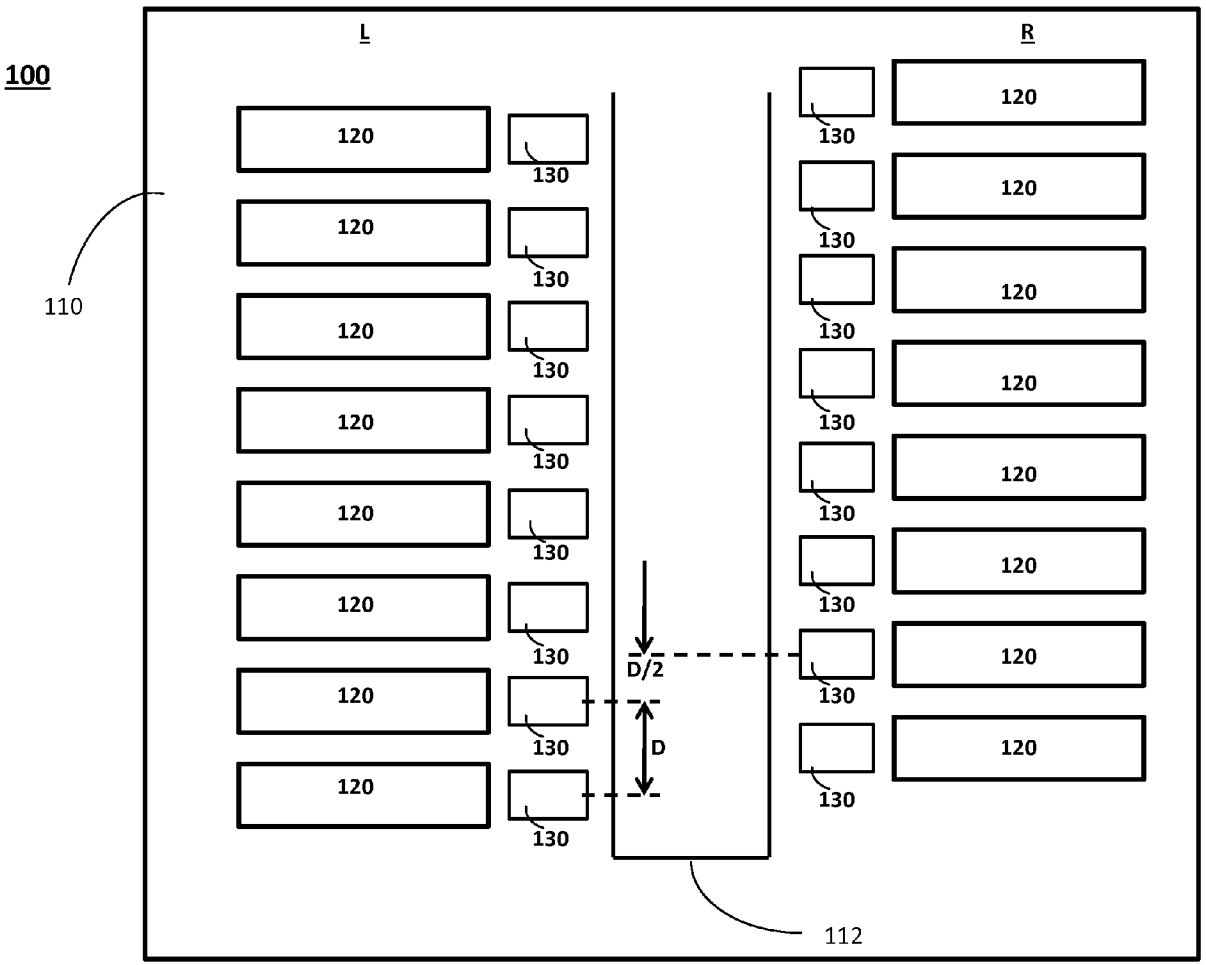
FIG. 3B is a second sequential block diagram of the thermal ejection chip.
Figure 3C:
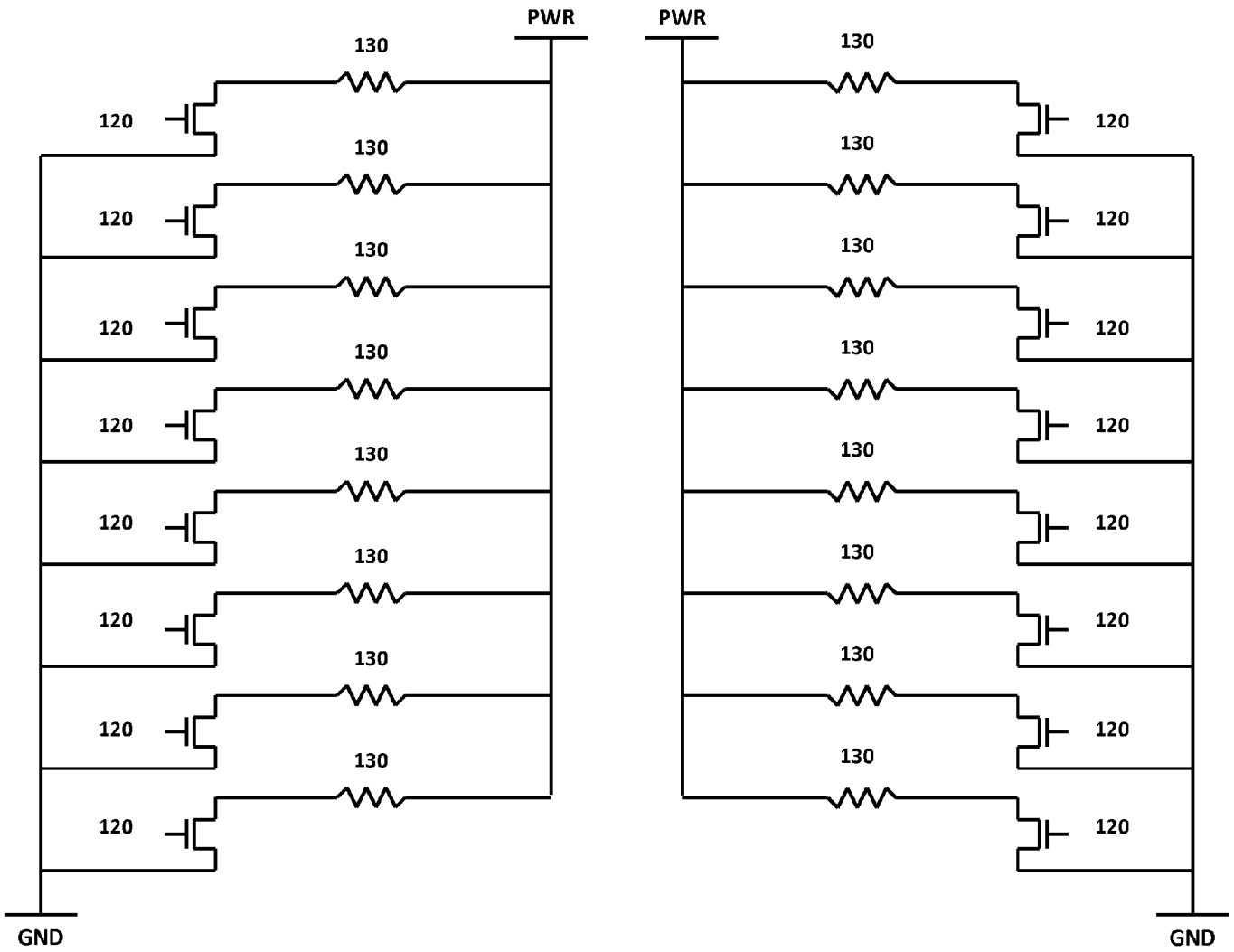
FIG. 3C is a circuit diagram of the thermal ejection chip shown in FIG. 3B.

Referring to FIG. 3B, a block diagram of thermal inkjet chip 100 is shown following BEOL processing such that each of a plurality of heaters 130 (fluid ejection elements) is disposed between respective FETs 120 and ink via 112 on either side of ink via 112. Heaters 130 may be fluid ejection actuators such as electro-thermal converting elements, e.g., electrical resistors, that can be formed as thin film elements on substrate 110. With additional reference to the circuit diagram of FIG. 3C, when electrical current flows through heaters 130, e.g., between two conductive elements of thermal ejection chip 100, thermal energy is produced by respective heaters 130. It will be understood that heaters 130 may be disposed along an interior portion of substrate 110, e.g., along a fluid channel extending between the surface of substrate 110 and the ink via 112, so that thermal energy is transferred to liquid ink flowing past heaters 130 upon activation of heaters 130.

Heaters 130, as shown, are arranged in columns L, R, so that vertically adjacent heaters 130 in a single column are separated a uniform distance D from one another along the ink via 112. In the exemplary embodiment shown, each vertically adjacent heater 130 of a single column is spaced about 42.3 μm from one another. However, each heater 130 of the column L on the left side of the ink via 112 is vertically offset from each corresponding heater 130 of the column R on the right side of the ink via 112 by a vertical distance of about half the uniform vertical distance D, e.g., D/2. In the exemplary embodiment shown, each heater 130 is vertically spaced a distance of about 21.2 μm from a corresponding heater 130 in the opposite column of heaters 130. Such a configuration may be used to define a 1200 dpi printhead.

In this regard, heaters 130 in the column L are vertically offset from heaters 130 in the column R such that the heaters 130 have a vertically staggered arrangement along ink via 112 so that a minimum amount of empty space, e.g., space devoid of a heater 130, is present on substrate 110 along ink via 112. Accordingly, droplets of liquid ink can be flash vaporized and ejected at a greater number of vertical positions, e.g., double, along thermal ejection chip 100 by advantageously using the symmetry of columns L, R of heaters 130 on opposite sides of ink via 112.

Figure 4A:
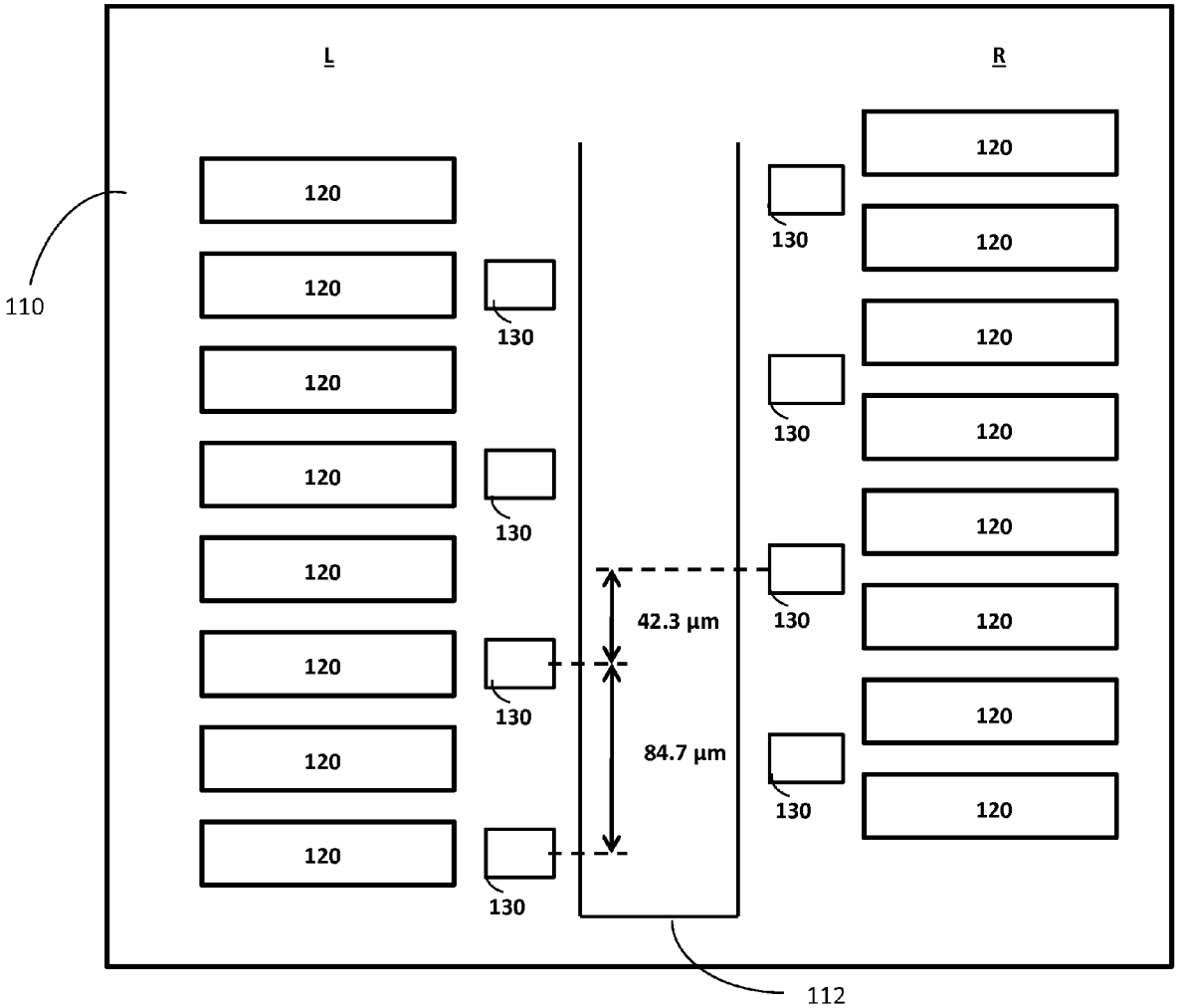
FIG. 4A is a first sequential block diagram of a thermal ejection chip during fabrication according to another exemplary embodiment of the present invention.

Turning now to FIG. 4A, a block diagram of an alternate embodiment of a thermal ejection chip, generally designated 200 (FIG. 4B) is shown during BEOL processing, with a fewer number of heaters 130 disposed on the substrate 110 as compared to thermal ejection chip 100 described above. In the exemplary embodiment shown, each vertically adjacent heater 130 is spaced apart a distance of 84.7 μm from one another, with the heaters 130 in column L offset from the corresponding heaters in column R by about 42.3 μm. Such a configuration, e.g., placement of heaters 130 per unit length, may be used to define, for example, a 600 dpi resolution printhead.

Such a reduction in the number of heaters 130 placed along thermal ejection chip 200 may be desirable based upon a particular inkjet printing application and/or due to considerations relating the fabrication process of the resulting thermal ejection chip, e.g., time, cost, material, and/or regulatory considerations. For example, it may be desirable to reduce resolution when printing on boxes or other non-traditional surfaces in a manufacturing environment. Industrial applications may be better served by printing with larger drops at a lower resolution. This provides improved throw distance (acceptable distance between the print head and the object) and enables higher overall print speeds.

In conventional printhead manufacturing processes, since the placement and arrangement of FETs is completed during FEOL processing, FEOL processing must be specifically tailored to the later BEOL processing of the heaters, with dependence on the desired resolution of the printhead. Such a disjoint in the method of fabrication of thermal ejection chips may result in, for example, greater monetary and/or time costs due to reconfiguring a fabrication and assembly process for different applications. Using the methods described in this invention, an inventory of wafers with a common base chip can be configured at the back-end process to serve multiple markets. For example, the same base chip could be configured as a 1200 dpi device for an office printer or as a 300 dpi device for industrial applications.

Accordingly, it would be desirable to provide a thermal ejection chip formed by FEOL processing that can later be tailored during BEOL processing so that the ejection chip can be used as a base "template" to achieve a variety of thermal generation profiles.

Figure 4B:
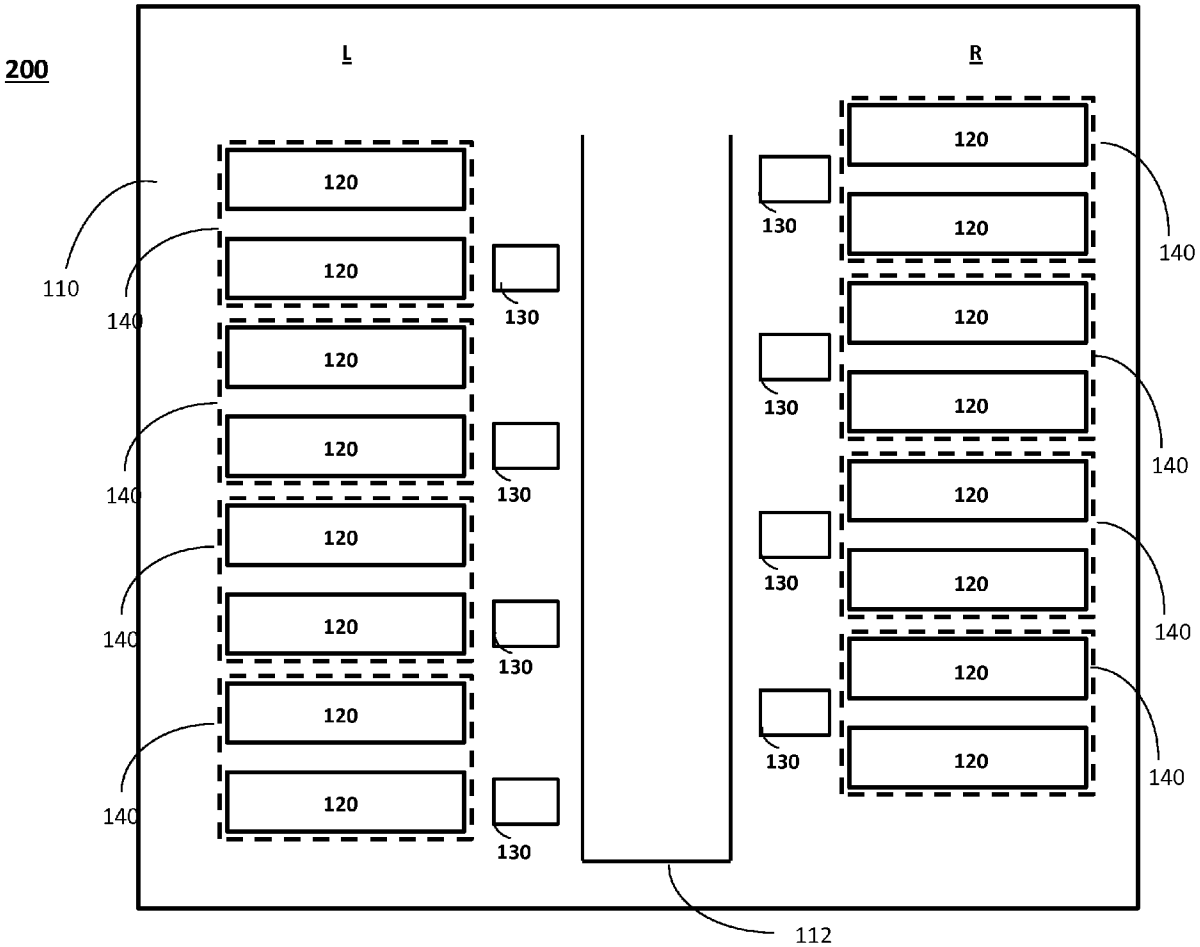
FIG. 4B is a second sequential block diagram of the thermal ejection chip.
Figure 4C:
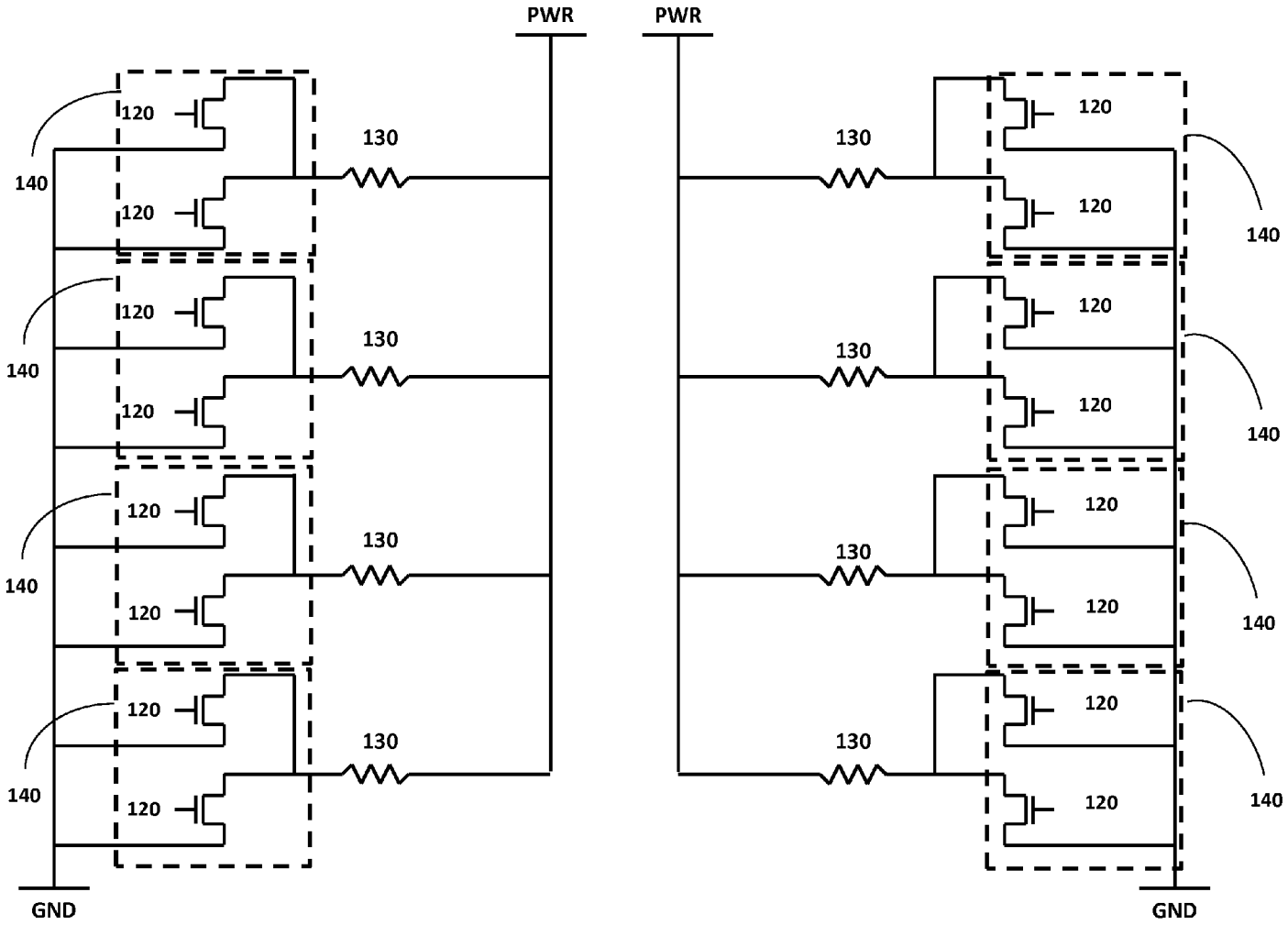
FIG. 4C is a circuit diagram of the thermal ejection chip shown in FIG. 4B.

Turning now to FIG. 4B, a number of individual FETs 120 are electrically connected in parallel to form a drive unit 140, for example with wiring or contacts added during BEOL processing. Drive unit 140, as shown, includes a pair of FETs 120 that together provide power for each corresponding heater 130. FIG. 4C shows an electrical circuit diagram of the resulting thermal ejection chip 100 with drive units 140. Each FET 120 of a drive unit 140 is electrically coupled in parallel with a heater 130 so that a plurality of power outputs from the pair of FETs 120 to the heater 130 are possible. For example, a fire pulse may be generated from a controller to activate either or both of FETs 120. In embodiments, one or both of the pair of FETs 120 of a drive unit 140 may be modulated to output a desired amount of electrical power, e.g., an amount of electrical power between and including 0 and twice the maximum electrical power output of both FETs 120.

In this regard, drive unit 140 presents the option to activate one or both of the coupled FETs 120 to achieve a desired performance of a corresponding heater 130. Thus, a greater number of FETs 120 than needed for a particular inkjet printing operation may be provided, with the option to allow the excess number of FETs 120 to remain inactive and/or to modulate a coupled pair of FETs 120 in a drive unit 140 to deliver the standard electrical power output of a single FET 120. A user is thus presented with the option of tailoring base chip 150 (FIG. 3A), through BEOL processing steps such as the depositing of electrical interconnects, to couple two or more FETs 120 into a configuration consistent with an arrangement of heaters 130 associated with one or more print resolutions. Such a configuration also obviates the need for custom-tailored FETs for different resolution printheads.

Figure 5A:
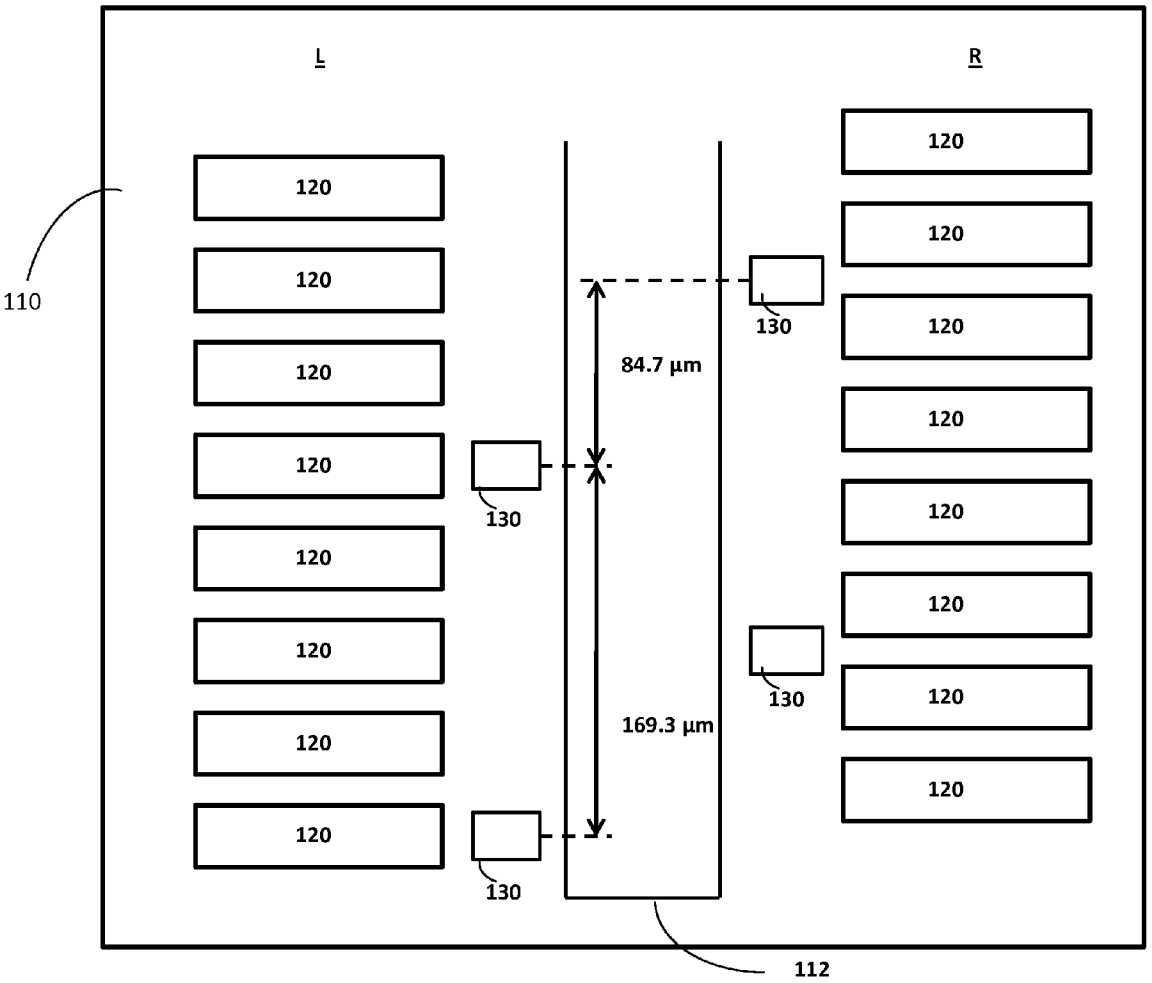
FIG. 5A is a first sequential block diagram of a thermal ejection chip during fabrication according to another exemplary embodiment of the present invention.

Turning now to FIG. 5A, a block diagram of an alternate embodiment of a thermal ejection chip, generally designated 300, is shown during BEOL processing, with a fewer number of heaters 130 disposed on the substrate 110 than in thermal ejection chips 100 and 200 described above. In the exemplary embodiment shown, each vertically adjacent heater 130 is spaced apart a distance of 169.3 μm from one another within a single column, with the heaters 130 in column L offset from the corresponding heaters in column R by about 84.7 μm. Such a configuration, e.g., placement of heaters 130 per unit length, may be used to define, for example, a 300 dpi resolution printhead.

Such a reduction in the number of heaters 130 placed along thermal ejection chip 100 may be desirable based upon a particular inkjet printing application and/or due to considerations relating the fabrication process of the resulting thermal ejection chip as described above.

Figure 5B:
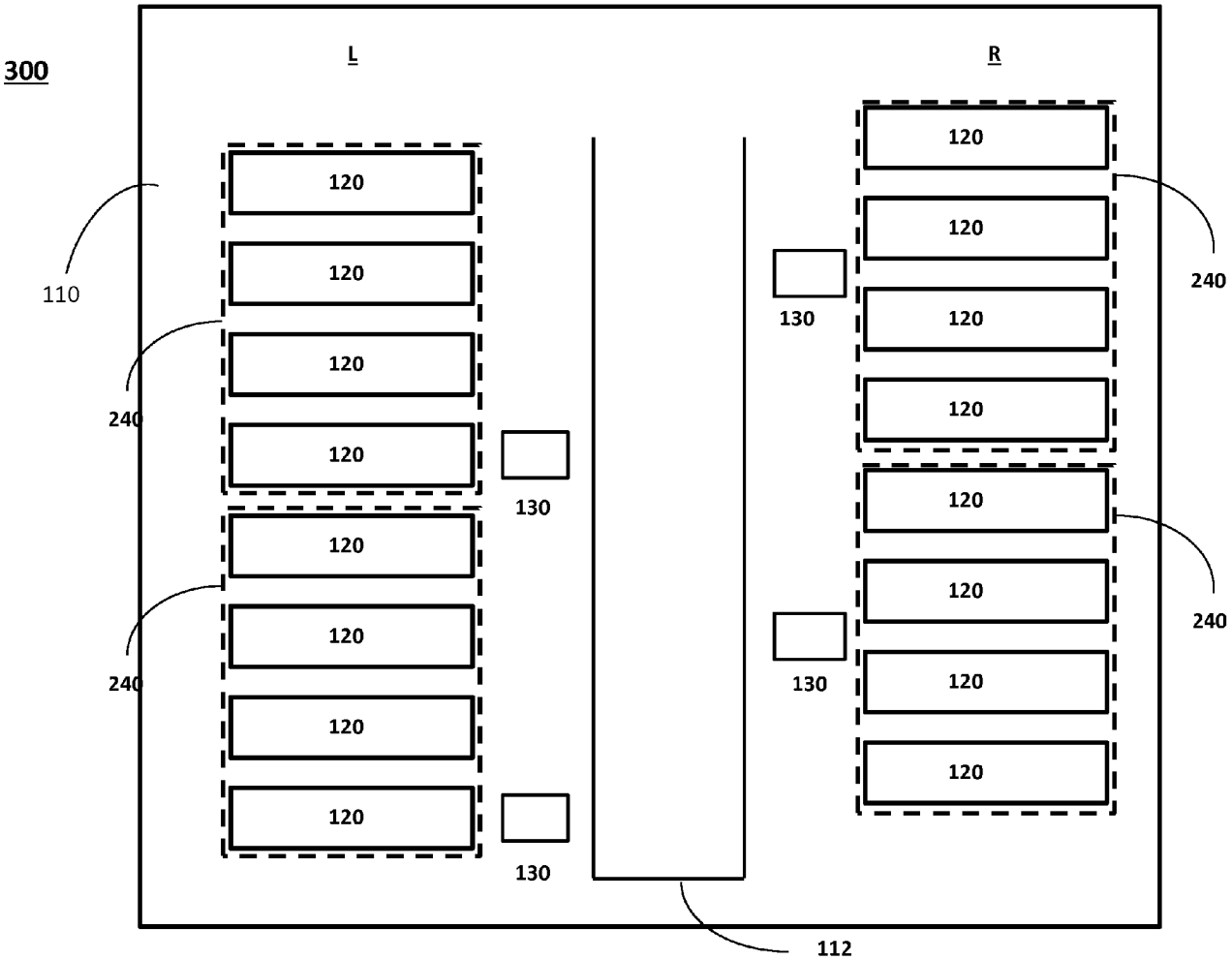
FIG. 5B is a second sequential block diagram of the thermal ejection chip.
Figure 5C:
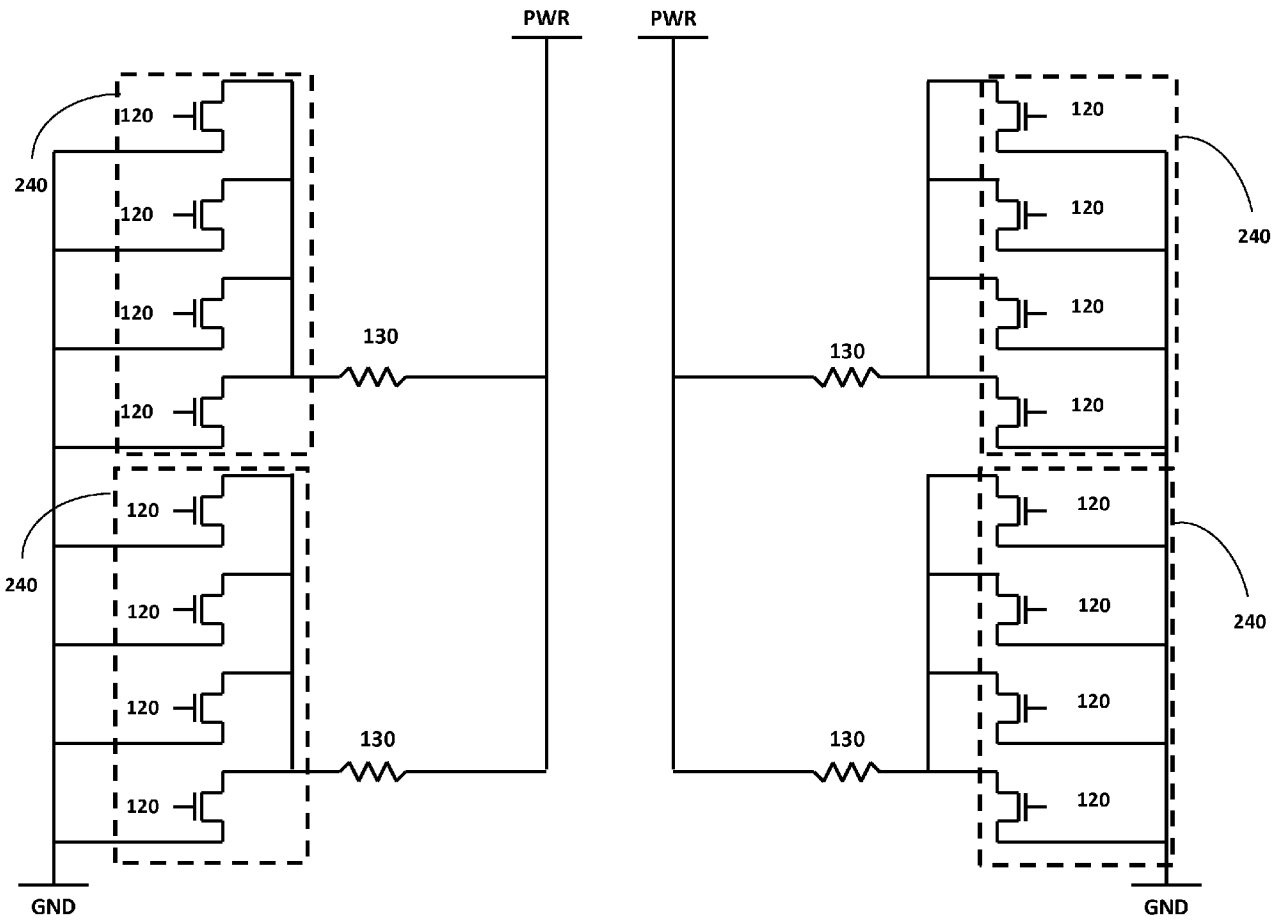
FIG. 5C is a circuit diagram of the thermal ejection chip shown in FIG. 5B.

Turning now to FIG. 5B, a number of individual FETs 120 are electrically connected in parallel to form drive units 240, for example, with wiring or contacts added during BEOL processing. Drive units 240, as shown, include a set of four FETs 120 that together provide power for each corresponding heater 130. FIG. 5C shows an electrical circuit diagram of thermal ejection chip 300 with drive units 240. Each FET 120 of a drive unit 240 is connected in parallel with a heater 130 such that the combined set of four FETs 120 can provide a plurality of power outputs to the heater 130. For example, a fire pulse may be generated from a controller to activate one, two, three, or four of the FETs 120 in drive unit 240. In embodiments, one or more of the set of FETs 120 of a drive unit 240 may be modulated to output a desired amount of electrical power.

In this regard, BEOL processing steps applied to base chip 150 (FIG. 3A) can be used to electrically couple four FETs 120 into drive units 240 to provide a desired power profile for a particular configuration of heaters 130 as described above.

In accordance with the exemplary embodiments described herein, a common base chip design 150 (FIG. 3A) is provided and two or more FETs 120 can be electrically coupled so that one of a plurality of arrangements of heaters 130, i.e., printhead resolutions, can be selected through subsequent BEOL processing steps.

It will be understood that a common base chip design is not limited to the number and/or configuration of FETs 120 described above. In embodiments, the number and/or configuration of FETs 120 on a base chip may be dictated by the highest resolution of vertical drop placement, i.e., a base chip may include a number of FETs 120 corresponding to a maximum desired number of heaters 130 in a one-to-one ratio (the highest resolution case), and the various FETs 120 may be coupled into drive units for lower resolution cases.

Figure 6:
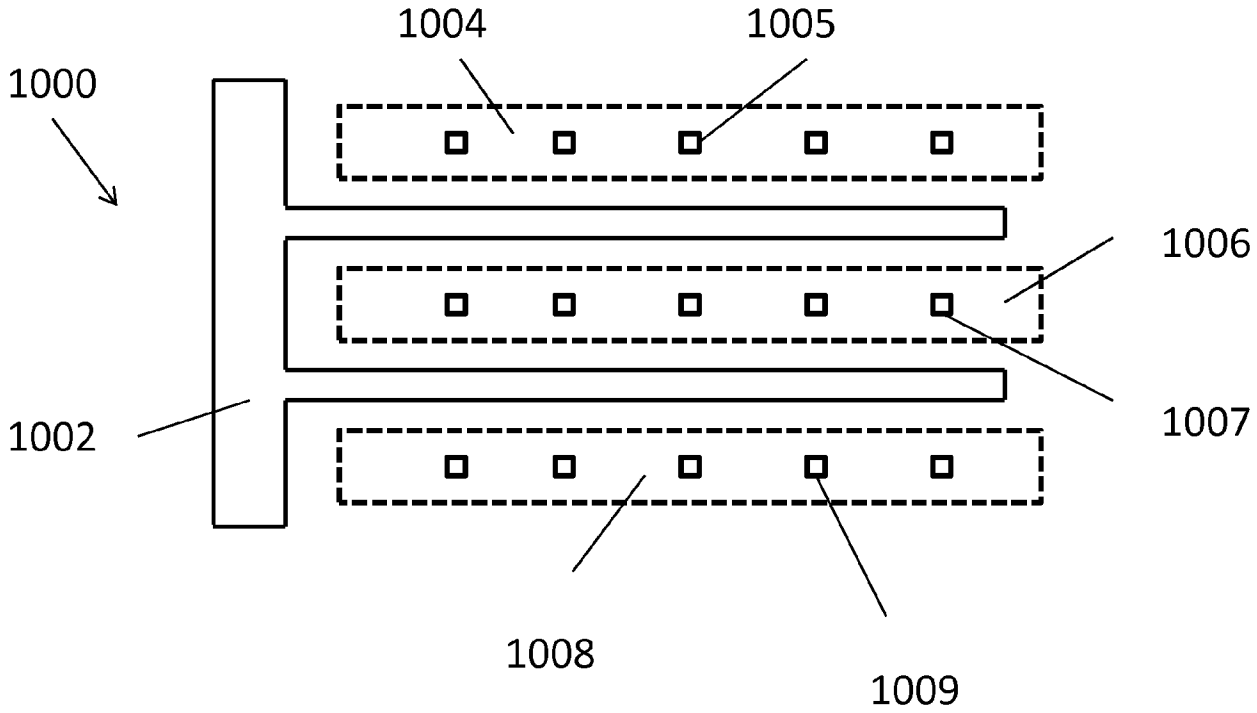
FIG. 6 is a layout view of an NMOS FET of a printhead chip according to an exemplary embodiment of the present invention after FEOL processing but before BEOL processing.
Figure 7A:
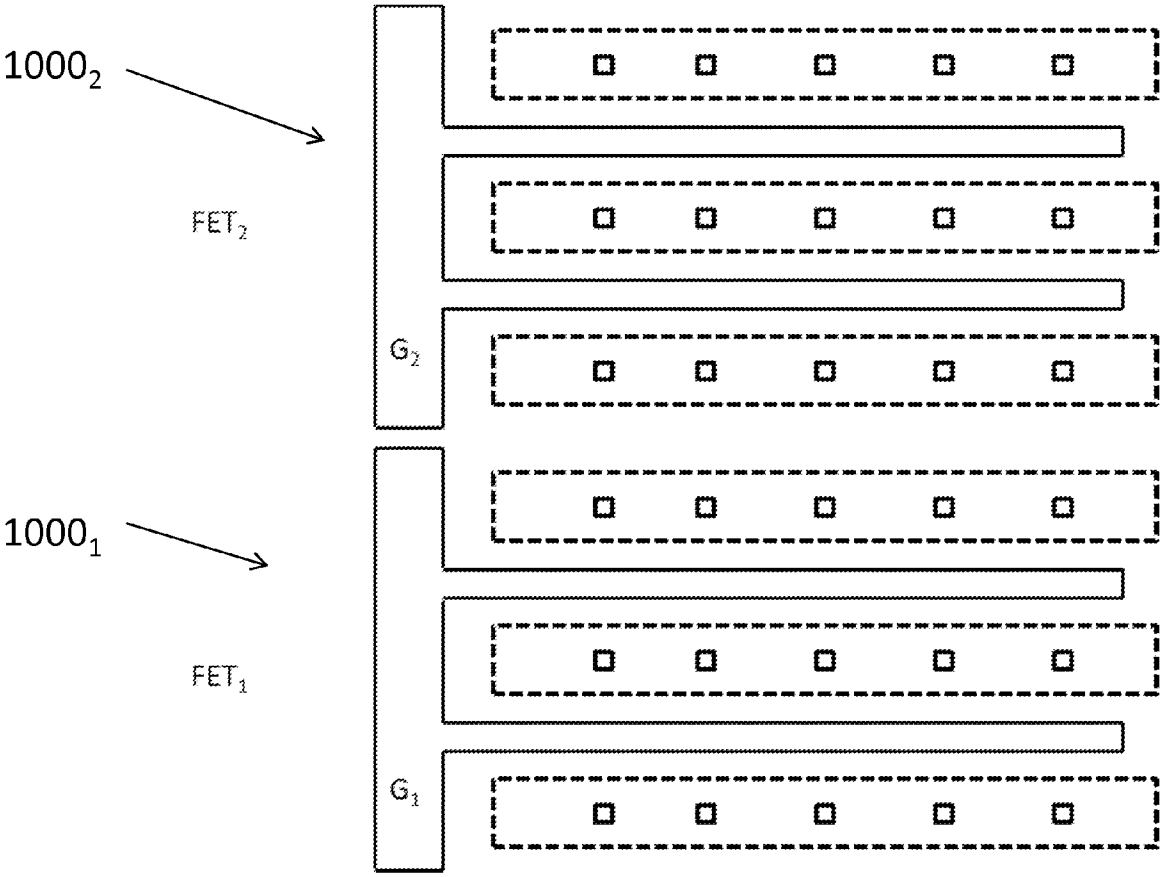
FIG. 7A is a partial layout view showing FETs of FIG. 6 arrayed on a substrate to form a base chip according to an exemplary embodiment of the present invention.

FIG. 6 shows a layout view of an NMOS FET, generally designated by reference 1000, of a printhead chip according to an exemplary embodiment of the present invention after FEOL processing but before BEOL processing. The FET 1000 may be formed in a P-type silicon substrate and includes a polysilicon gate 1002, a first N+ implant forming a first source region 1004 with contacts 1005, a second N+ implant forming a first drain region 1006 with contacts 1007 and a third N+ implant forming a second source region 1008 with contacts 1009. As shown in FIG. 7A, a number of such FETs $\mathbf{1000}_1$, $\mathbf{1000}_2$ may be arrayed on a substrate to form the base chip 150.

Figure 7B:
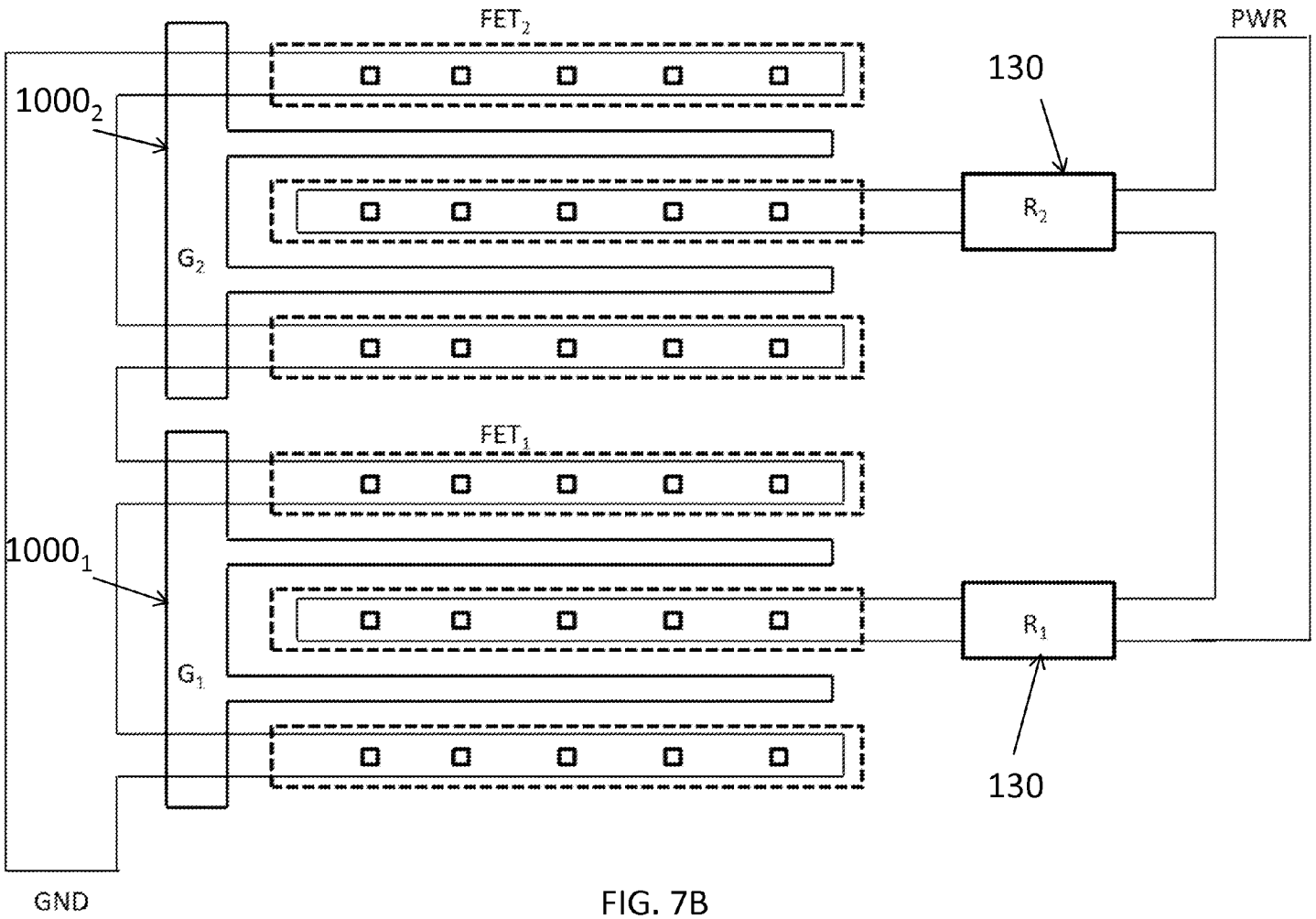
FIG. 7B is a partial layout view of a base chip according to an exemplary embodiment of the present invention after BEOL processing to form a printhead chip having a resolution of 1200 dpi.

FIG. 7B shows a partial layout view of the base chip 150 according to an exemplary embodiment of the present invention after BEOL processing to form a printhead chip having a resolution of 1200 dpi. The BEOL processing results in the formation of heaters 130 and metallization to form power, ground and FET connections.

Figure 7C:
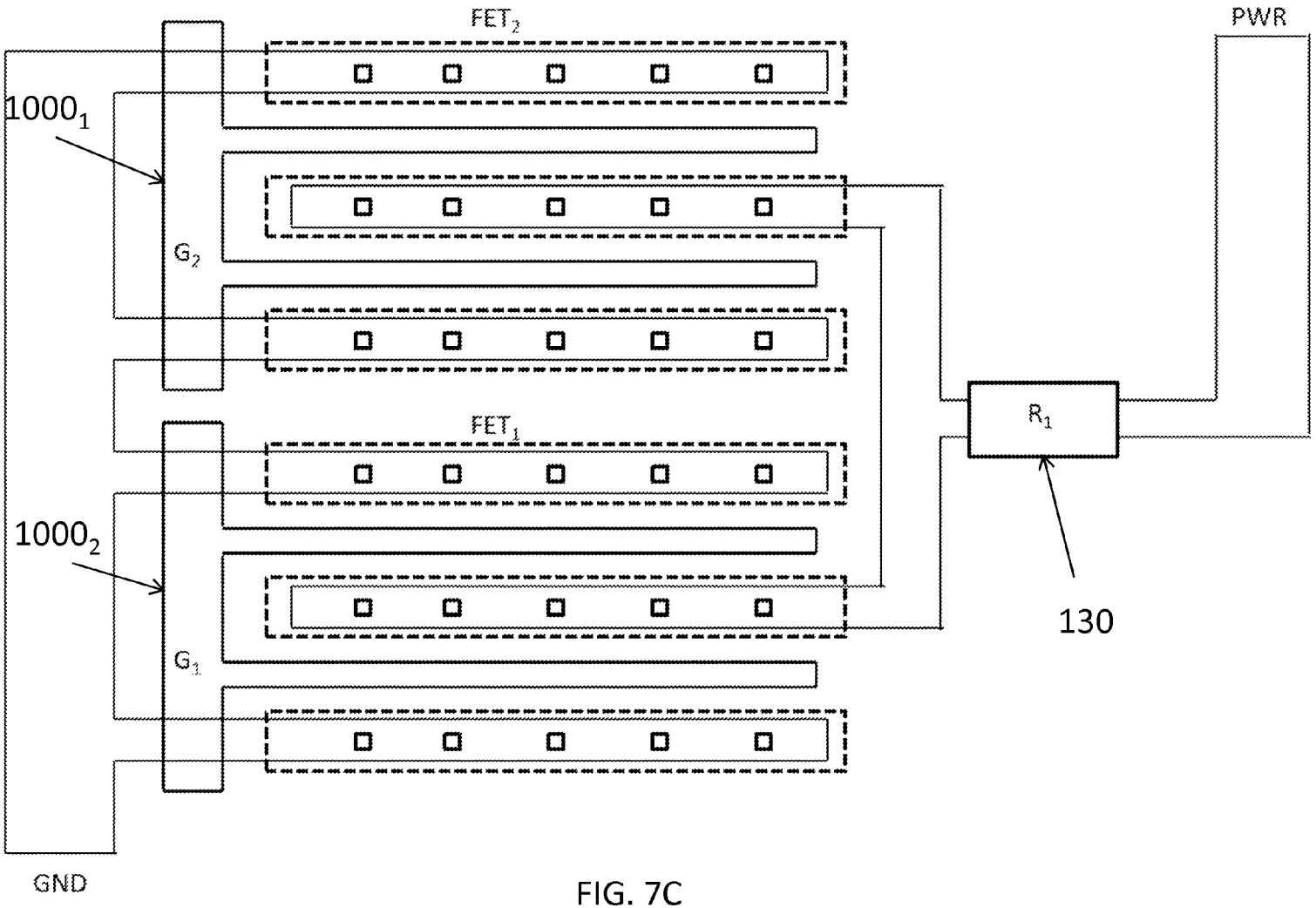
FIG. 7C is a partial layout view of a base chip according to an exemplary embodiment of the present invention after BEOL processing to form a printhead chip having a resolution of 600 dpi.

As shown in FIG. 7C, BEOL processing of the base chip 150 can be modified to form a printhead chip having a resolution of 600 dpi. In particular, each heater 130 is electrically connected to a set of two FETs $\mathbf{1000}_1$, $\mathbf{1000}_2$. Similarly, in order to produce a 300 dpi printhead chip, the BEOL processing can be modified so that each heater 130 is electrically connected to a set of four FETs 1000.

While this invention has been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

The invention claimed is:

1. A method of fabricating a fluid ejection chip, comprising:

providing a substrate;

forming a plurality of drive elements on the substrate;

forming a plurality of groups of drive elements, each group comprising at least two drive elements of the plurality of drive elements electrically coupled in parallel;

forming a plurality of fluid ejection devices on the substrate; and electrically coupling each fluid ejection device of the plurality of fluid ejection devices with a single respective group of the plurality of groups of drive elements so that the plurality of drive elements selectively supply electrical power to the plurality of fluid ejection devices for causing fluid to be expelled from the fluid ejection chip in accordance with image data.

2. The method of claim 1, further comprising the step of forming a via on the substrate that provides fluid communication between the fluid ejection devices and a fluid supply.

3. The method of claim 1, wherein the plurality of drive elements comprise transistors.

4. The method of claim 1, wherein the step of electrically coupling each fluid ejection device with a single respective group of drive elements comprises depositing an electrical interconnect on the substrate.

5. The method of claim 1, wherein each group comprises four drive elements.

6. A printhead comprising a fluid ejection chip formed by the method of claim 1.

7. A fluid ejection chip comprising;

a substrate;

a plurality of groups of drive elements formed on the substrate, each group comprising at least two drive elements electrically coupled in parallel; and a plurality of fluid ejection devices disposed on the substrate, each fluid ejection device of the plurality of fluid ejection devices electrically coupled with a single respective group of the plurality of groups of drive elements so that the plurality of drive elements selectively supply electrical power to the plurality of fluid ejection devices for causing fluid to be expelled from the fluid ejection chip in accordance with image data.

8. The fluid ejection chip of claim 7, wherein the substrate further comprises a via that provides fluid communication between the fluid ejection devices and a fluid supply.

9. The fluid ejection chip of claim 8, wherein each fluid ejection device of the plurality of fluid ejection devices is vertically spaced a uniform distance from a vertically-adjacent fluid ejection device along the via.

10. The fluid ejection chip of claim 9, wherein the plurality of fluid ejection devices is formed in two columns, each column on an opposing side of the via.

11. The fluid ejection chip of claim 10, wherein each column is vertically offset from the other column.

12. The fluid ejection chip of claim 11, wherein each column is vertically offset from the other column by a distance that is half a uniform vertical distance between each vertically-adjacent fluid ejection device of the plurality of fluid ejection devices.

13. The fluid ejection chip of claim 7, wherein the plurality of groups of drive elements comprises transistors.

14. The fluid ejection chip of claim 7, wherein each group comprises four drive elements electrically coupled in parallel.

15. An inkjet printer comprising:

a housing;

a carriage adapted to reciprocate along a shaft disposed within the housing;

one or more printhead assemblies arranged on the carriage so that the one or more printhead assemblies eject ink onto a print medium as the carriage reciprocates along the shaft in accordance with a control mechanism, wherein at least one of the one or more printhead assemblies comprises:

a printhead comprising:

a fluid ejection chip comprising;

a substrate;

a plurality of groups of drive elements formed on the substrate, each group comprising at least two drive elements electrically coupled in parallel; and a plurality of fluid ejection devices disposed on the substrate, each fluid ejection device of the plurality of fluid ejection devices electrically coupled with a single respective group of the plurality of groups of drive elements so that the plurality of drive elements selectively supply electrical power to the plurality of fluid ejection devices for causing ink to be expelled from the printhead in accordance with image data.

16. The inkjet printer of claim 15, wherein the substrate further comprises a via that provides fluid communication between the fluid ejection devices and a fluid supply.

17. The inkjet printer of claim 16, wherein each fluid ejection device of the plurality of fluid ejection devices is vertically spaced a uniform distance from a vertically-adjacent fluid ejection device along the via.

18. The inkjet printer of claim 17, wherein the plurality of fluid ejection devices is formed in two columns, each column on an opposing side of the via.

19. The inkjet printer of claim 18, wherein each column is vertically offset from the other column.

20. The inkjet printer of claim 15, wherein each group comprises four drive elements electrically coupled in parallel.

* * * * *